US006139224A

United States Patent [19]

Michel et al.

[11] Patent Number: 6,139,224

[45] Date of Patent: Oct. 31, 2000

[54] SEMI-SUBMERSIBLE PLATFORM FOR OFFSHORE OIL FIELD OPERATION AND METHOD OF INSTALLING A PLATFORM OF THIS KIND

[75] Inventors: Dominique Michel, Paris; Francois Gabriel Sedillot, Velizy-Villacoublay; Nicolas Francois André Parsloe, Beauchamp; Vincent Frédéric Paul Foglia, Aulnay-Sous-Bois, all of France

[73] Assignee: Doris Engineering, Paris, France

[21] Appl. No.: 09/209,471

[22] Filed: Dec. 11, 1998

[30] Foreign Application Priority Data

Dec. 12, 1997 [FR] France ..... 97 15774

[51] Int. Cl.[7] ..... B63B 35/44

[52] U.S. Cl. ..... 405/224; 114/264; 405/196; 405/209

[58] Field of Search ..... 405/204, 224, 405/224.1, 223.1, 205, 207–209, 206; 114/264, 265

[56] References Cited

U.S. PATENT DOCUMENTS

| | | | |
|---|---|---|---|
| 2,837,897 | 6/1958 | Nedderman et al. | 405/196 |
| 3,385,069 | 5/1968 | Estes | 405/196 |
| 3,433,024 | 3/1969 | Diamond et al. | 405/196 |
| 3,577,946 | 5/1971 | Horton | 405/223.1 X |
| 4,193,714 | 3/1980 | Gjerde | 405/204 |
| 4,266,887 | 5/1981 | Corder | 405/224 X |
| 4,395,160 | 7/1983 | DeJong | 405/198 X |
| 4,398,487 | 8/1983 | Ortloff et al. . | |
| 4,427,319 | 1/1984 | Mayr | 405/196 |
| 5,609,442 | 3/1997 | Horton | 405/204 X |
| 5,791,819 | 8/1998 | Christiansen | 405/224 |

FOREIGN PATENT DOCUMENTS

| | | |
|---|---|---|
| 1366164 | 11/1964 | France . |
| 9706340 | 2/1997 | WIPO . |

OTHER PUBLICATIONS

French Search Report dated Aug. 7, 1998.

*Primary Examiner*—Dennis L. Taylor
*Attorney, Agent, or Firm*—Stevens, Davis, Miller & Mosher, L.L.P.

[57] ABSTRACT

The platform comprises a buoyant sub-structure comprising a base and a plurality of columns upstanding from said base, a buoyant deck-hull mounted on the columns and means for ballasting and deballasting at least the base of said sub-structure. It further comprises means for tangentially guiding said deck-hull on said columns during deployment of the platform into a predetermined configuration by ballasting of the sub-structure while the deck-hull is floating and means for locking said deck-hull to the columns in said predetermined configuration.

12 Claims, 3 Drawing Sheets

SEMI-SUBMERSIBLE PLATFORM FOR OFFSHORE OIL FIELD OPERATION AND METHOD OF INSTALLING A PLATFORM OF THIS KIND

BACKGROUND OF THE INVENTION

The present invention concerns a semi-submersible platform for offshore oil field operation and a method of installing such a platform. The invention more particularly concerns a platform of the above kind which comprises a) a buoyant sub-substructure consisting of a base and a plurality of columns upstanding from said base, b) a buoyant deck-hull mounted on said column and c) means for ballasting and deballasting at least said base of said sub-structure.

At present there is increasing interest in operating offshore oil fields at great depths, from several hundred meters to 1 500 meters or more, for example, from platforms carrying on their surface the equipment necessary for drilling, production of and possibly storing petroleum products extracted from the field. With fields at these depths it is not possible to use gravity platforms resting on the sea floor. So-called "semi-submersible" platforms can be used, floating on the surface of the water and moored by taut anchor lines or by catenary anchor lines. The use of the latter type of anchorage can be associated with sizing a deep draught platform of the above kind to reduce heave due to swell and consequently facilitates the installation of well heads at the surface.

Because of its deep draught, a platform of the above kind is conventionally constructed in deep water ports or other coastal sites, such as are found in Scotland and in the fjords of Norway in particular. The use of such a deep water site is necessary in particular for installing the top deck of the platform. The platform is then towed out to its final site and anchored there.

Alternatively, if only a shallow water marine site is available, the deck must be installed at the final offshore operation site, which necessitates the use of substantial and costly plant such as powerful floating cranes.

Also known in themselves are semi-submersible platforms of the type described in the preamble to this description in which, after the deck and the sub-structure are constructed, the former is mounted on the latter and the resulting combination is launched so that it can be towed to the final installation site with a shallow draught. The base of the sub-structure then floats on the surface of the water and the deck rests on the base, at the foot of the column or columns upstanding vertically from the base. On arrival on site the sub-structure is lowered into the water, causing the structure to float on the deck. The sub-structure is lowered using a rack and pinion type mechanism, for example, this motion being combined with appropriate ballasting of the sub-structure. The lowering of the base of the sub-structure is stopped at a predetermined required depth, for example in the order of 100 m. Relying on the buoyancy of the sub-structure, the deck is raised to the top of the columns using the same mechanism, to a height that provides a convenient freeboard between the deck and the surface of the water. Other procedures for installing a platform of the above kind have been proposed but they comprise the requirement for a mechanism for raising the deck at the final installation site and, of course, means for locking the deck to its support columns at its final position.

This mechanism must be able to assure precise lateral guidance of the deck as it is raised and to withstand very high vertical loads due to the important weight of the deck.

As a result these mechanisms account for a significant proportion of the cost and the reliability of the platform.

The means used to immobilize the deck on the columns in its final position conventionally consist in casting a concrete joint in the case of a concrete base or using welds in the case of a metal structure. These locking means are therefore non-reversible, i.e. they cannot be unlocked, which rules out or complicates replacement of the deck or dismantling of the platform, for example at the end of its service life.

Reversible locking means using "combs" meshing with the teeth of the rack of the deck-lifting mechanism are known in themselves but this solution obviously requires the presence of a mechanism which, as already mentioned, significantly increases the cost of constructing a platform of the above kind.

SUMMARY OF THE INVENTION

Accordingly, the aim of the present invention is to provide a semi-submersible platform for offshore oil field operation having a deep draught, able to be constructed in dry dock and of the type described in the preamble to this description, which does not have the drawbacks of prior art platforms of this type and which, in particular, does not require any costly mechanism to move the deck on the columns of the sub-structure.

Another aim of the present invention is to provide a platform of the above kind in which the connection between the sub-structure and the deck can be unlocked.

A further aim of the invention is to provide a method of installing a platform of the above kind at its final site.

The above aims of the invention, together with others that will become apparent on reading the following description, are achieved by a semi-submersible platform for offshore oil field operation of the type which comprises a) a buoyant sub-structure comprising a base and a plurality of columns upstanding from said base, b) a buoyant deck-hull mounted on said column and (c) means for ballasting and deballasting at least said base of said sub-structure, which platform is remarkable in that it comprises (d) means for tangentially guiding a base of said deck-hull on said columns during deployment of the platform into a predetermined configuration by ballasting of the sub-structure while the deck-hull is floating and (e) means for locking said deck-hull to said columns in said predetermined configuration.

As explained below, a platform having the above structure can be deployed at its final installation site using only the forces of gravity and of Archimedean upthrust on the components of the platform, so that the costly mechanism for raising the platform conventionally employed in the prior art for such deployment can be dispensed with.

According to one feature of the invention, the guide means comprise a) a rectilinear vertical guide path formed on the columns and b) at least one bearing member mounted on said deck-hull to bear on said guide path.

According to another feature of the present invention, the locking means are designed so that they can be unlocked in a simple manner to enable demounting or changing of the deck-hull mounted on the sub-structure of the platform.

The invention provides a method of installing the platform at its final site wherein:

a) (i) the sub-structure is constructed in dry dock, (ii) the deck-hull is constructed at the site away from said dry dock, (iii) the dry dock is flooded, (iv) the sub-structure is loaded with the deck-hull delivered by a barge and (v) the base of the sub-structure is unballasted to cause said assembly to float, b) a floating assembly comprising the sub-structure and the deck-hull resting on the base of said sub-structure is towed to the final installation site, c) the sub-structure is ballasted in order to lower it towards the sea floor with the deck-hull floating on the surface of the water and thereby assuring hydrostatic stability of the combination comprising the sub-structure and the deck-hull, d) ballasting of the sub-structure is stopped when the base reaches a predetermined depth at which the deck-hull is secured to said columns e) said sub-structure is deballasted until the deck-hull has been raised to a predetermined height above the surface of the water, and f) the sub-structure is anchored to the sea floor by catenary anchor lines.

BRIEF DESCRIPTION OF THE DRAWINGS

Other features and advantages of the present invention will become apparent upon reading the following description and examining the accompanying drawings, in which.

DESCRIPTION OF A PREFERRED EMBODIMENT

Figure 1:
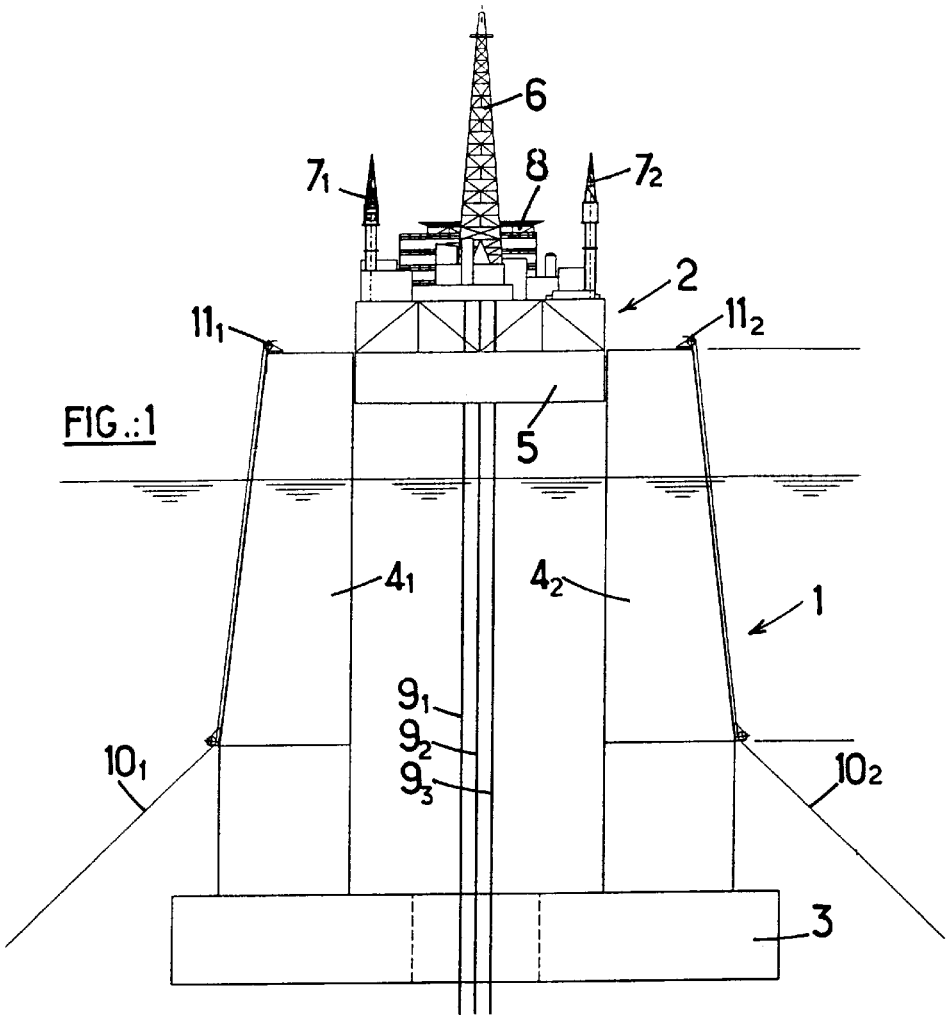
FIGS. 1 and 2 are respectively elevation and plan views of one embodiment of a semi-submersible platform in accordance with the present invention.
Figure 2:
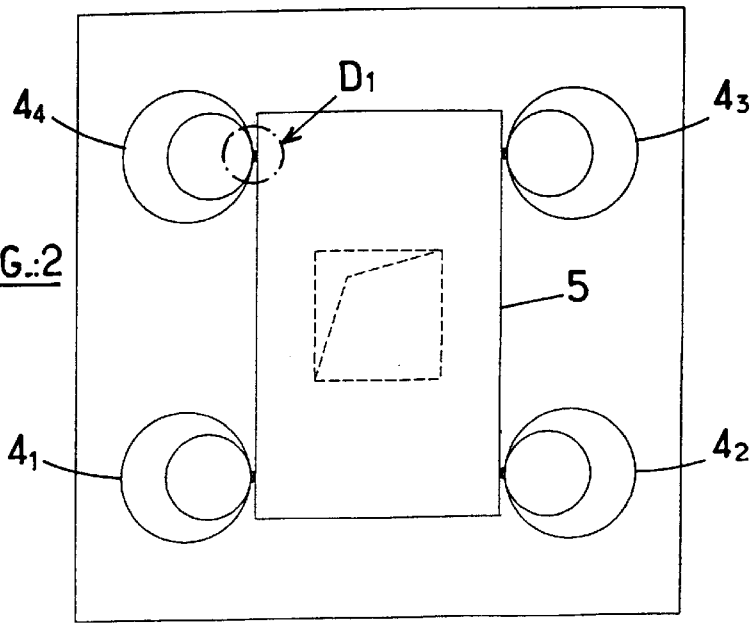

FIGS. 1 and 2 of the accompanying drawings show that the platform represented essentially comprises a sub-structure 1 and a deck 2. The sub-structure 1 comprises a square base 3 and four columns $\mathbf{4}_1$, $\mathbf{4}_2$, $\mathbf{4}_3$, $\mathbf{4}_4$ upstanding from the base 3, the deck 2 being fixed to the top end of the columns as shown in FIG. 1.

The sub-structure 1 is represented merely as an illustrative and non-limiting example. The base could equally have a rectangular, triangular, circular or other shape. Likewise, the base could support a different number of deck support columns (for example 2 or 3 columns).

The base can be made of reinforced concrete or metal. For deep water oil field operation, at depths in the range 500 m to 1 500 m, for example, it can have a draught of approximately 100 m. A draught of this magnitude considerably reduces heave of the platform due to swell and therefore enables the use of the conventional well system with well heads at the surface.

The base 3 is in the form of a parallelepiped-shape caisson incorporating compartments for storing extracted petroleum products and ballasting/deballasting compartments. The latter are used during installation of the platform, as explained below. During operation of the platform they can also be used for "dynamic" ballasting to compensate the difference between the density of the stored products and that of sea water, according to the volume of stored products.

The columns $\mathbf{4}_1$ through $\mathbf{4}_4$ can be made from the same material as the base or a different material. Their function is to support the deck. They also delimit flotation compartments and can accommodate various "utilities" such as pipes, pumps, storage tanks for various fluids.

The columns shown by way of example are frustoconical or cylindrical in shape. Each has a vertical generatrix facing the deck 2 as shown in FIG. 2 from which it is clear that the rectangular base 5 of the deck 2 is tangential to the vertical generatrices of the four columns $\mathbf{4}_1$, $\mathbf{4}_2$, $\mathbf{4}_3$, $\mathbf{4}_4$ in the vicinity of two opposite ends of two facing vertical faces of the deck base. In accordance with the invention, this disposition provides lateral guidance of the deck by the columns during ballasting of the sub-structure, as explained below.

The deck 2 is preferably a metal structure with the base 5 in the form of a caisson or hull providing the buoyancy of the deck, whence the designation deck-hull used for this type of deck. It carries the usual equipment: drilling tower 6, crane $\mathbf{7}_1$, $\mathbf{7}_2$, crew quarters 8, etc. needed to drill offshore wells and then to bring products extracted from the well to the surface via transfer pipes $\mathbf{9}_1$, $\mathbf{9}_2$, $\mathbf{9}_3$, etc. suspended from the deck. The sub-structure 1 is equipped with catenary anchor lines $\mathbf{10}_1$, $\mathbf{10}_2$, etc. tensioned by winches $\mathbf{11}_1$, $\mathbf{11}_2$, etc. at the tops of the columns $\mathbf{4}_1$ through $\mathbf{4}_4$.

The means for lateral guidance of the deck-hull on the columns of the sub-structure during deployment of the platform (see below) and the means for locking the deck-hull to said columns will now be described with reference to FIGS. 3 through 8.

Figure 3:
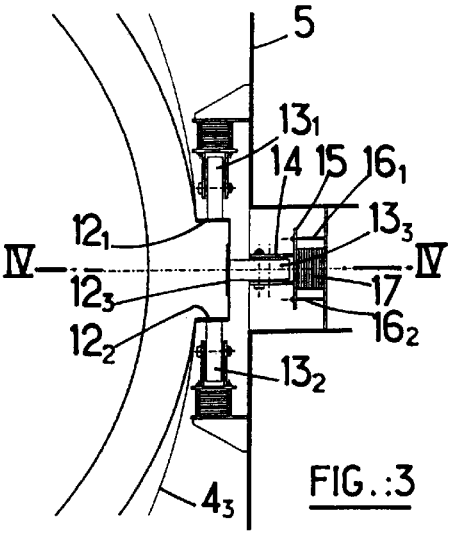
FIG. 3 is a part-sectional view in a horizontal plane of the detail $D_1$ from FIG. 2 showing the means for guiding the deck-hull on a column of the platform in accordance with the present invention.

FIG. 3 is an enlargement of the detail $D_1$ from FIG. 2 which shows the interface of the column $\mathbf{4}_3$ with the base 5 of the deck-hull 2. There are interfaces having the same structure between each of the other columns $\mathbf{4}_2$ through $\mathbf{4}_4$ and the base 5.

FIG. 3 shows that the column $\mathbf{4}_3$ includes a vertical guide path ($\mathbf{12}_1$, $\mathbf{12}_2$, $\mathbf{12}_3$) of substantially rectangular section and having two substantially vertical faces $\mathbf{12}_1$, $\mathbf{12}_2$ symmetrical about the vertical median plane of the path passing through the section line IV and a third vertical face $\mathbf{12}_3$ perpendicular to the other two. Bearing members $\mathbf{13}_1$, $\mathbf{13}_2$, $\mathbf{13}_3$ attached to the base 5 of the deck-hull 2 bear on the respective faces $\mathbf{12}_1$, $\mathbf{12}_2$, $\mathbf{12}_3$. One illustrative and non-limiting example of such bearing members is rollers rotating about horizontal axes. Each roller can be mounted like the roller $\mathbf{13}_3$ on a support 14 mounted on a plate 15 sliding horizontally on guides $\mathbf{16}_1$, $\mathbf{16}_2$, etc., the roller being spring-loaded towards the guide path ($\mathbf{12}_1$, $\mathbf{12}_2$, $\mathbf{12}_3$) by a spring member 17 mounted between the plate 15 and the base 5 and consisting of a block of an elastomer material, for example.

Figure 4:
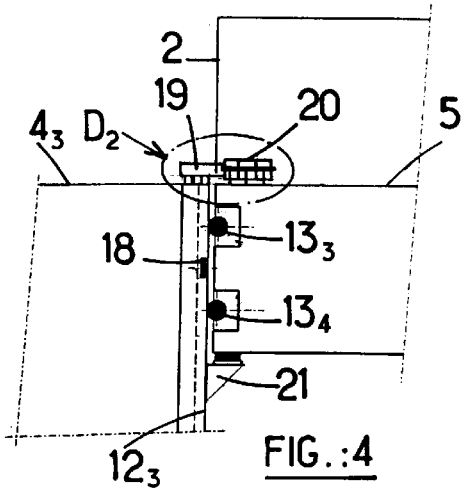
FIG. 4 is a diagrammatic sectional view of the guide means taken along the section line IV—IV in FIG. 3.

The sectional view in FIG. 4 shows that the guide means described above in fact comprise two rollers $\mathbf{13}_1$, $\mathbf{13}_2$ located at the same level bearing on an area 18 of the facing faces $\mathbf{12}_1$, $\mathbf{12}_2$ of the guide path and two rollers $\mathbf{13}_3$, $\mathbf{13}_4$ bearing on the face $\mathbf{12}_3$, the latter two rollers being vertically separated. This disposition prevents the deck-hull pivoting about a horizontal axis during movement relative to the columns, as explained below.

The guide path ($\mathbf{12}_1$, $\mathbf{12}_2$, $\mathbf{12}_3$) and the rollers $\mathbf{13}_i$ (i from 1 through 4) are used to lower the sub-structure into the water from an initial floating position by ballasting it, the deck-hull remaining in floating position as explained below. During the lowering of the sub-structure 1 the columns $\mathbf{4}_i$ guide the deck-hull laterally between them until the top ends of the columns reach the level of the floating deck-hull, in the position shown in FIG. 4, in which the ballasting of the sub-structure must be stopped and the deck-hull fixed to the columns.

Figure 5:
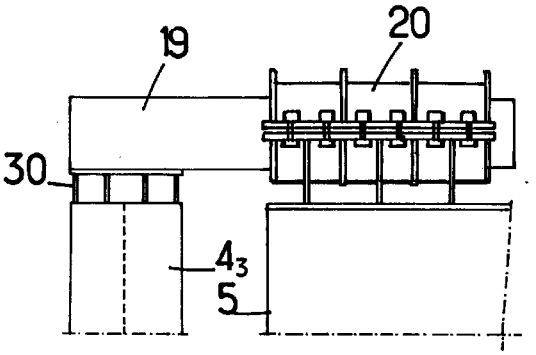
FIG. 5 is a diagrammatic representation to a larger scale of the detail $D_2$ from FIG. 4 corresponding to a first embodiment of the locking means of the platform in accordance with the invention.
Figure 7:
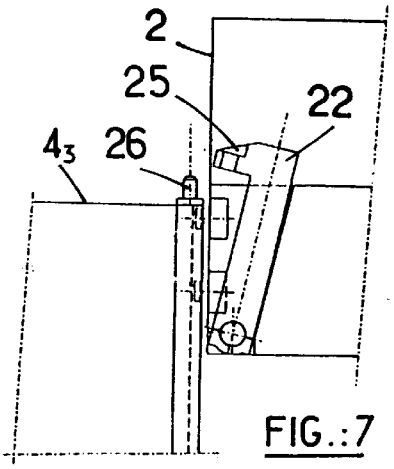
FIGS. 7 and 8 are diagrammatic views of another embodiment of the locking means of the platform in accordance with the invention shown in the unlocking and locking positions, respectively.
Figure 8:
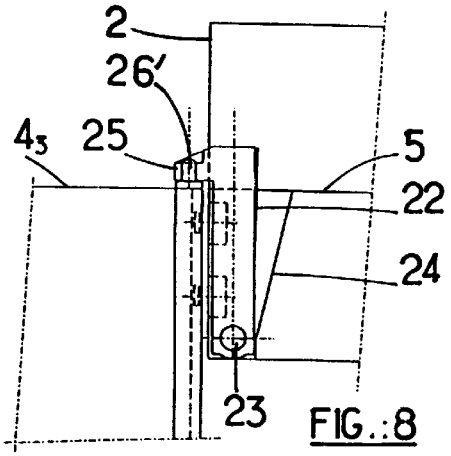

In a first embodiment shown in FIGS. 4 and 5 this fixing is obtained by means of a plurality of locking means such as the means within the circle delimiting the detail $D_2$ in FIG. 4, FIG. 5 showing this detail to a larger scale. FIG. 5 shows that the means comprise a bar 19 sliding in a sleeve 20 fixed to the base 5 of the deck-hull. The bar is mobile between a first position in which it is separated from the interface between the base 5 and the column $\mathbf{4}_3$ and a second position (that shown in FIG. 5) in which it passes through the interface to rest on a support 30 at the top of the column $\mathbf{4}_3$.

During the lowering of the sub-structure by ballasting it, which is described below, ballasting is stopped when the top of the column is slightly below the locking means (19, 20). The bar 19 is then pushed over the associated column, as shown in FIG. 5. Slight deballasting of the sub-structure then engages the bar 19 with the support 30. The resulting coupling can be reinforced by fixing brackets 21 to the columns $\mathbf{4}_i$ (see FIG. 4) to support the under-face of the base 5 of the deck-hull, which operation can be carried out when the deck-hull is out of the water.

The resulting coupling between the sub-structure 1 and the deck-hull 2 can be permanent or temporary. A temporary coupling enables operations such as replacing the deck-hull with another deck-hull, for example one carrying different equipment, or facilitates demounting of the platform at the end of its service life.

Figure 6:
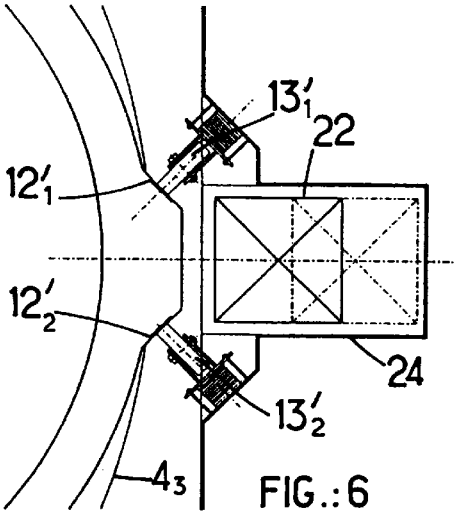
FIG. 6 is a part-sectional view in a horizontal plane of another embodiment of the guide means of the platform in accordance with the present invention.

FIG. 6 shows a variant of the coupling means shown in FIG. 3. They differ in that the guide path comprises two faces $\mathbf{12'}_1$, $\mathbf{12'}_2$ inclined to each other rather than parallel like the corresponding faces $\mathbf{12}_1$, $\mathbf{12}_2$ of the FIG. 3 embodiment. This disposition is advantageous in that it provides sufficient guidance of the deck-hull with rollers $\mathbf{13'}_1$, $\mathbf{13'}_2$ rolling on only two rolling paths rather than on three as in the FIG. 3 embodiment. Of course, the pairs of rollers are advantageously at two vertically separated levels, like the rollers $\mathbf{13}_3$, $\mathbf{13}_4$ shown in FIG. 4.

The disposition of the rollers $\mathbf{13'}_1$, $\mathbf{13'}_2$ provides a space between them for a variant of the locking means shown in FIGS. 4 and 5. The locking means comprise a plurality of arms like the arm 22 shown in FIGS. 7 and 8 pivoting about a horizontal pivot 23 on the base 5 of the deck-hull. The arm 22 moves in a housing 24 of the base between a first position in which it is retracted into the housing and separated from the facing column $\mathbf{4}_3$ (see FIG. 7) and a second position in which its mobile end 25 engages a vertical axis pin 26 at the top of the column $\mathbf{4}_3$ to lock the deck-hull to the column (see FIG. 8), identical mechanisms locking the deck-hull to the other columns.

Of course, the locking sequence can be identical to that described above in connection with the locking means shown in FIGS. 4 and 5 and therefore can comprise slight overballasting of the sub-structure followed by slight deballasting of the sub-structure to cause the pin 26 to enter a complementary bore 26' in the end 25 of the arm 22.

Note that in an alternative arrangement of the above locking means the pin 26 could be mounted on the base 5 of the deck-hull and the arm 22 on the facing column.

The structure of the platform in accordance with the invention having been described, and in particular the specific means enabling relative movement of the sub-structure and the deck-hull and locking thereof in predetermined positions, the method of installing the platform from its construction in dry dock to its final site in a deep water oil field will now be described with reference to FIGS. 9A through 9J which show diagrammatically the various successive phases of the installation process.

Figure 9C:
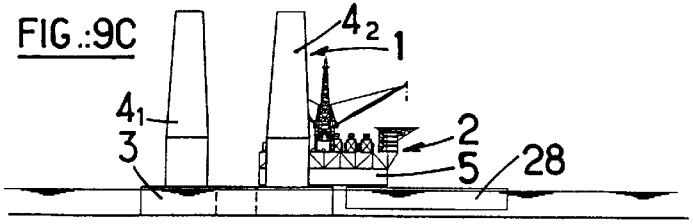
FIGS. 9A through 9J show the various successive steps of the method of installing the platform in accordance with the present invention at its final site.
Figure 9B:
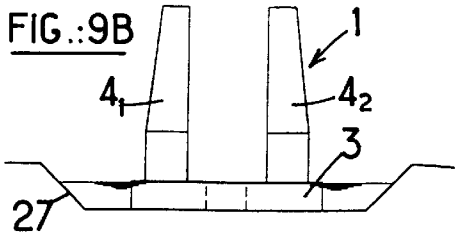
Figure 9A:
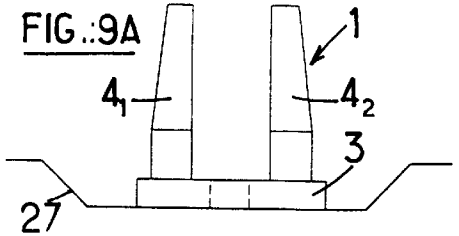
Figure 9G:
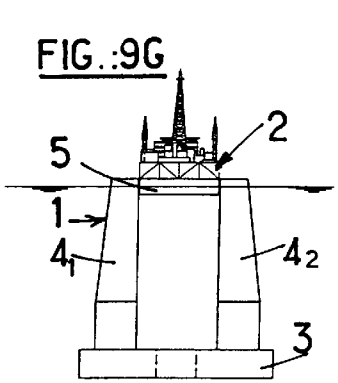

FIG. 9A shows the sub-structure 1 at the end of its construction in a dry dock 27 having a draught in the order of fifteen meters, for example. FIG. 9B shows the flooding of the dry dock, the sub-structure being ballasted and therefore remaining on the ground rather than floating. Flooding the dock enables delivery of the deck-hull 2 on a floating barge 28. The deck-hull is constructed away from the dry dock 27. Thus the means of constructing a sub-structure in reinforced concrete, for example, and a deck-hull essentially of metal, for example, can advantageously be specialized for their respective functions on separate yards, which would create more problems if both constructions are carried out at a single construction site.

Figure 9F:
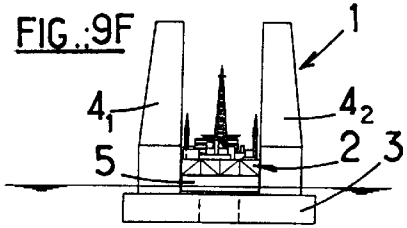
Figure 9E:
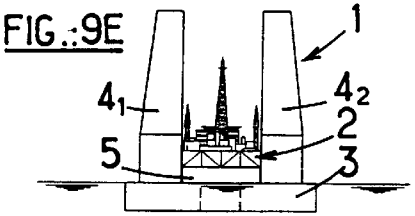
Figure 9D:
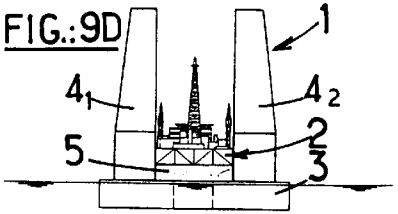
Figure 9J:
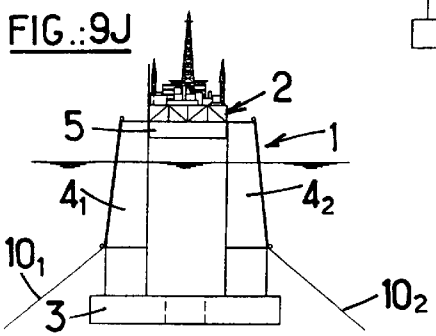
Figure 9I:
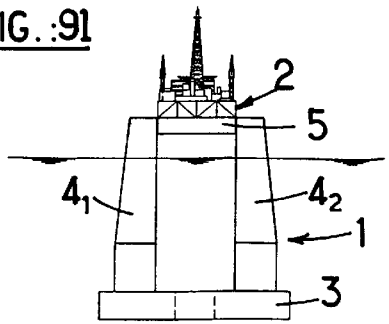

The deck-hull is loaded onto the sub-structure by a shifting process as shown in FIG. 9C. The deck-hull is slid between the columns as far as the position shown in FIG. 2. The rollers $\mathbf{13}_i$ or $\mathbf{13'}_i$ are then mounted around the guide paths of the four columns. The base 2 of the sub-structure 1 is then deballasted (FIG. 9D) so that the sub-structure/deck-hull combination floats and can be towed in deep water (FIG. 9D) to its final installation site in the oil field to be exploited. On reaching the site (FIG. 9E) the base 3 is ballasted again, which lowers the sub-structure 1 and causes the deck-hull 2 to float (FIG. 9F). Ballasting and lowering of the sub-structure 1 are then continued, the hydrostatic stability of the combination being assured by the deck-hull 2 floating on the surface of the water, because the sub-structure 1 alone is not stable in all phases of immersion. The rollers attached to the deck-hull 2 roll freely on the guide paths attached to the columns $\mathbf{4}_i$ of the sub-structure 1 during its lowering, during which the columns $\mathbf{4}_i$ laterally guide the deck-hull.

When the top surfaces of the columns $\mathbf{4}_i$ are slightly below the facing locking means on the deck-hull 2 the ballasting of the base 3 is stopped, the base having arrived at a predetermined depth which, in accordance with the invention, is substantially equal to the sum of the draught of the platform in its final position on site (for example approximately 100 m) and the freeboard of the deck-hull above the water in the final position (for example approximately 25 m).

Figure 9H:
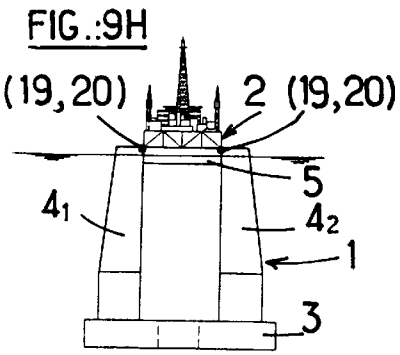

The appropriate locking means (19, 20) or (22, 26) are actuated to prevent any further movement of the sub-structure relative to the deck-hull (FIG. 9H).

The sub-structure is then deballasted to raise the deck-hull to the height assuring the predetermined freeboard mentioned above (FIG. 9I) without using any specific lifting mechanism, which is one advantageous feature of the present invention. The catenary anchor lines $\mathbf{10}_1$, $\mathbf{10}_2$, etc. are then installed between the sub-structure of the platform and the sea floor.

It is now clear that the present invention achieves the stated aims, namely providing a semi-submersible platform with catenary anchor lines designed to be installed in deep water, which can be constructed entirely in dry dock or in shallow water, but which nevertheless comprises a ballasted base that can be sunk deep beneath the surface of the water, the platform therefore being very stable in terms of heave due to swell. The platform is installed on site using only gravity and the Archimedean upthrust on its component parts, without recourse to the costly lifting mechanisms used for this purpose in the prior art, thanks to the use of a deck-hull having its own buoyancy.

Of course, the invention is not limited to the embodiment described and shown, which is presented as an example only. Thus the invention is not limited to a platform anchored by catenary anchor lines but applies equally to a floating platform with taut anchor lines. The invention applies equally to a deep draught single-column "SPAR" type platform assuring any oil operation function such as drilling, production, storage of petroleum products, offloading of such products or living quarters.

What is claimed is:

1. A semi-submersible platform for offshore oil field operation of the type which comprises (a) a buoyant sub-structure comprising a base and a plurality of columns upstanding from said base, (b) a buoyant deck-hull mounted on said columns and (c) means for ballasting and deballasting at least said base of said sub-structure, said platform further comprising (d) means for tangentially guiding a base of said deck-hull on said columns during deployment of the platform into a predetermined configuration by ballasting of said sub-structure while said deck-hull is floating, and (e) means for locking said deck-hull to said columns in said predetermined configuration.

2. A platform according to claim 1, wherein said guide means comprise a) a rectilinear vertical guide path set up on said columns and b) at least one bearing member mounted on said deck-hull to bear on said guide path.

3. A platform according to claim 2, wherein said guide path has at least two faces in vertical planes substantially symmetrical about a median vertical plane of the path and in that at least one bearing member bears on each of said faces.

4. A platform according to claim 1, wherein said bearing members are rollers rotating about a horizontal axis.

5. A platform according to claim 4, wherein said bearing members comprise two vertically separated sets of rollers bearing on the guide path.

6. A platform according to claim 1, wherein each roller is spring-loaded against the guide path by a spring member.

7. A platform according to claim 1, wherein said locking means comprise at least one bar mobile horizontally in the vicinity of a columns/deck-hull interface between a first position in which it is separated from said interface and a second position in which it passes through said interface to lock said deck-hull to said columns at a predetermined level thereof.

8. A platform according to claim 1, wherein said locking means comprise at least one arm pivoting on a horizontal pivot attached to said deck-hull or to said columns in the vicinity of the columns/deck-hull interface and mobile between a first position in which it is retracted into said deck-hull or said columns and a second position in which a mobile end of which engages with said columns or said deck-hull, respectively, to lock said deck-hull to said columns at a predetermined level thereof.

9. A platform according to claim 1, having a deep draught to limit heave.

10. A platform according to claim 9, adapted to be anchored to the sea floor by catenary anchor lines.

11. A platform according to claim 9, adapted to be anchored to the sea floor by taut lines.

12. A method of installing a platform according to claim 1, comprising the steps of:

a) (i) constructing the sub-structure in dry dock, (ii) constructing the deck-hull at a site away from the dry dock, (iii) flooding the dry dock, (iv) loading the sub-structure with said deck-hull delivered by a barge and (v) deballasting the base of the sub-structure to cause the assembly to float, b) towing a floating assembly comprising said sub-structure and said deck-hull resting on the base of said sub-structure, to a final installation site, c) ballasting said sub-structure in order to lower it towards the sea floor with said deck-hull floating on the surface of the water and thereby assuring hydrostatic stability of the combination comprising said sub-structure and said deck-hull, d) stopping said ballasting of said sub-structure when said structure base reaches a predetermined depth at which said deck-hull is secured on said columns of said base, e) deballasting said sub-structure until said deck-hull has been raised to a predetermined height above the surface of the water, and f) anchoring said sub-structure to the sea floor by anchor lines.

* * * * *